US005558224A

United States Patent [19]

Fogle

[11] Patent Number: 5,558,224

[45] Date of Patent: Sep. 24, 1996

[54] TRIANGULAR ARTICLE CARRIER

[75] Inventor: James C. Fogle, Marietta, Ga.

[73] Assignee: Riverwood International Corporation, Atlanta, Ga.

[21] Appl. No.: 436,536

[22] Filed: May 8, 1995

[51] Int. Cl.[6] ..... B65D 65/06; B65D 5/42

[52] U.S. Cl. ..... 206/427; 206/161; 206/194; 206/499; 229/115; 229/117.14

[58] Field of Search ..... 229/115, 117.14, 229/117.15, 117.13, 117.12; 206/427, 161, 446, 499, 162, 168, 194

[56] References Cited

U.S. PATENT DOCUMENTS

| | | | |
|---|---|---|---|
| 2,173,494 | 9/1939 | Rous | 206/168 |
| 2,204,118 | 6/1940 | Brogden | 229/115 |
| 2,205,341 | 6/1940 | Brogden | 229/115 X |
| 3,222,190 | 12/1965 | Davis | 206/499 X |
| 3,357,544 | 12/1967 | Gingher | 229/115 X |
| 3,428,235 | 2/1969 | Randazzo | 206/427 |
| 3,528,599 | 9/1970 | Alvarez | 229/115 X |
| 4,863,021 | 9/1989 | Crittenden | 229/115 X |
| 5,037,026 | 8/1991 | Hanko | 229/115 X |

FOREIGN PATENT DOCUMENTS

| | | | |
|---|---|---|---|
| 1223558 | 6/1960 | France | 229/115 |
| 1338230 | 11/1973 | United Kingdom | 229/115 |

*Primary Examiner*—Bryon P. Gehman

[57] ABSTRACT

A triangular carrier comprised of a top panel and converging end panels connected to triangular side panels. The carrier holds a plurality of rows of articles, each article extending between the side panels, with each row containing a greater number of articles than the next lower row. For an equilateral carrier, each row contains one more article than the next lower row. Openings at the corners of the carrier allow portions of adjacent articles to protrude.

10 Claims, 2 Drawing Sheets

TRIANGULAR ARTICLE CARRIER

FIELD OF THE INVENTION

This invention relates to a carrier for packaging articles such as beverage cans. More particularly, it relates to carrier of which is of generally triangular shape.

BACKGROUND OF THE INVENTION

Many different types of carriers have been employed to package beverage cans. Most types, however, are merely variations of either fully enclosed sleeve-type carriers or wrap-around carriers. Wrap-around carriers are used to package relatively small numbers of cans, typically holding groups of six or eight. They are usually less expensive than sleeve-type carriers since their open-ended construction requires less material than a fully enclosed carrier. Sleeve-type carriers are commonly employed to package larger numbers of cans, typically twelve or more. In both cases the cans or other packaged articles are arranged in two or more adjacent rows, with each row containing an equal number of articles. This results in carriers of conventional rectilinear shape which include rectangular side panels, top panels and bottom panels.

Such carriers have a number of advantages. They are convenient to carry and consumers are accustomed to using and handling them. Further, they can be easily grouped and stacked for shipping and display.

Regardless of any improvements which may be made to the design of the carriers, the extent to which the amount of paperboard or other material used to fabricate them may be reduced is limited by the parameters of their basic rectilinear design. Also, the flat bottom panel of many of these carriers is typically formed from two flaps which must be tightly connected, often by mechanical locks, so as to be able to support the weight of the packaged articles. This increases the cost of packaging machines, since they have to be provided with mechanical elements and controls to automatically connect the locks, and limits the speed at which the machines can be run.

It is an object of the invention to provide a carrier which can be used to package beverage cans or other articles, but which does not have the drawbacks discussed above.

BRIEF SUMMARY OF THE INVENTION

The carrier of the invention is of generally triangular shape, comprised of generally triangular side panels and generally rectangular top and end panels. The carrier is designed to form a package containing a plurality of articles extending between the side panels and arranged in a plurality of rows. The upper row is adjacent the top panel, and each row contains a greater number of articles than the next lower row.

Preferably, the bottom row of the articles is comprised of a single article and the bottom portion of the carrier includes an opening through which a portion of the bottom article protrudes. The upper corners of the carrier may also include openings through which portions of adjacent articles protrude. The carrier is well adapted to receive cylindrical articles, such as beverage cans, in which case the carrier would be in the general shape of an equilateral triangle.

The carrier is formed from a small, integral blank which requires quite limited folding and gluing operations to fabricate the finished package. Carriers of this type may be stacked in honeycomb fashion to form a strong compact unit for purposes of shipping or display.

These and other features and aspects of the invention will be readily ascertained from the detailed description of the preferred embodiments described below.

DETAILED DESCRIPTION OF THE PREFERRED EMBODIMENTS

Figure 1:
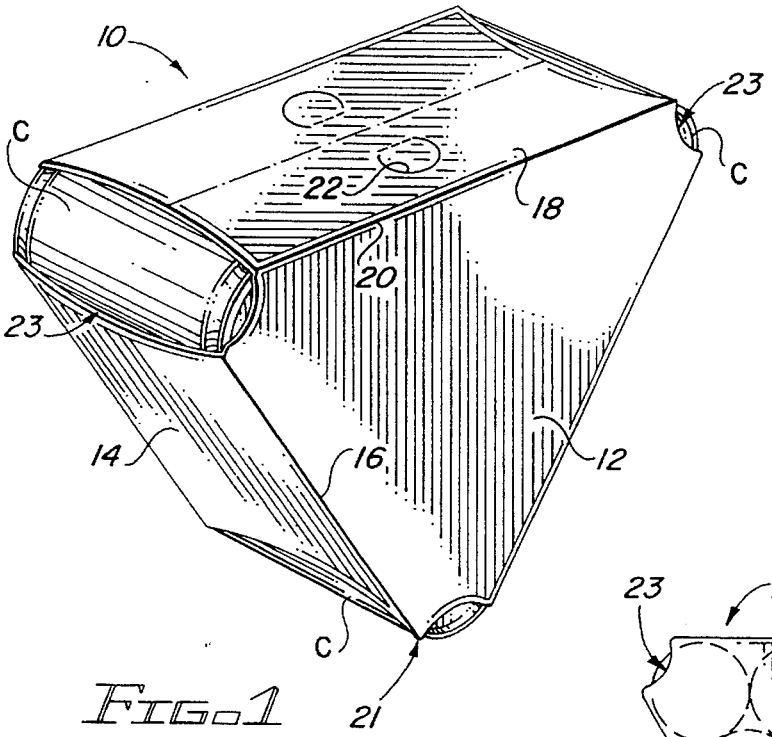
FIG. 1 is a pictorial view of a basket-style carrier incorporating the invention.

Referring to FIG. 1, a carrier 10 embodying the concepts of the invention is comprised of opposite side panels 12 which are generally in the shape of equilateral triangles. Opposite end panels 14 are connected to the side panels at the fold lines 16, and a top panel 18 is connected to the side panels at the fold lines 20. The top panel includes spaced finger holes 22 for lifting and carrying the carrier.

Figure 2:
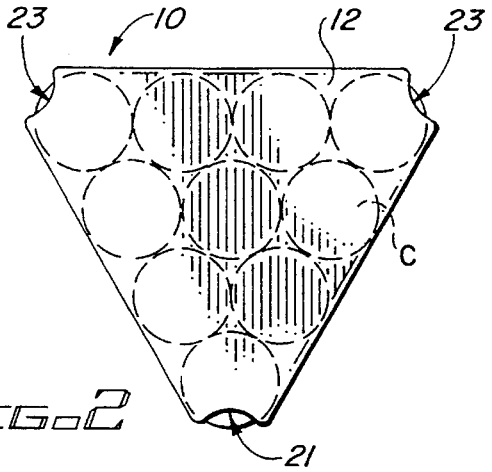
FIG. 2 is a side elevation of the carrier, with the location of packaged cans indicated by broken lines.

As illustrated in FIGS. 1 and 2, the carrier contains ten beverage cans C extending across the width of the carrier so that their ends abut the side panels 12. The cans are arranged in a row of four cans adjacent the top panel, and in rows of three, two and one in descending order down to the bottom of the carrier. The end cans in each row contact the adjacent end panels. There is no bottom panel in the carrier. Instead, the lower end of the carrier terminates in an opening 21 of smaller dimensions than the can dimensions, which prevents the lowermost can from being pushed out through the opening. Cutaway areas 23 are also present at the upper portions of the end panels. These openings, which are also of lesser dimensions than those of the cans, allow substantial portions of the upper end cans to be exposed to view. This has the beneficial result of permitting a consumer to identify the contents of the package by the packaged article itself in addition to whatever graphics or printed material may be on the outside of the package. Although the openings may be of such shape that the end and top panels are not exactly rectangular, they may accurately be considered to be of generally rectangular shape.

Figure 3:
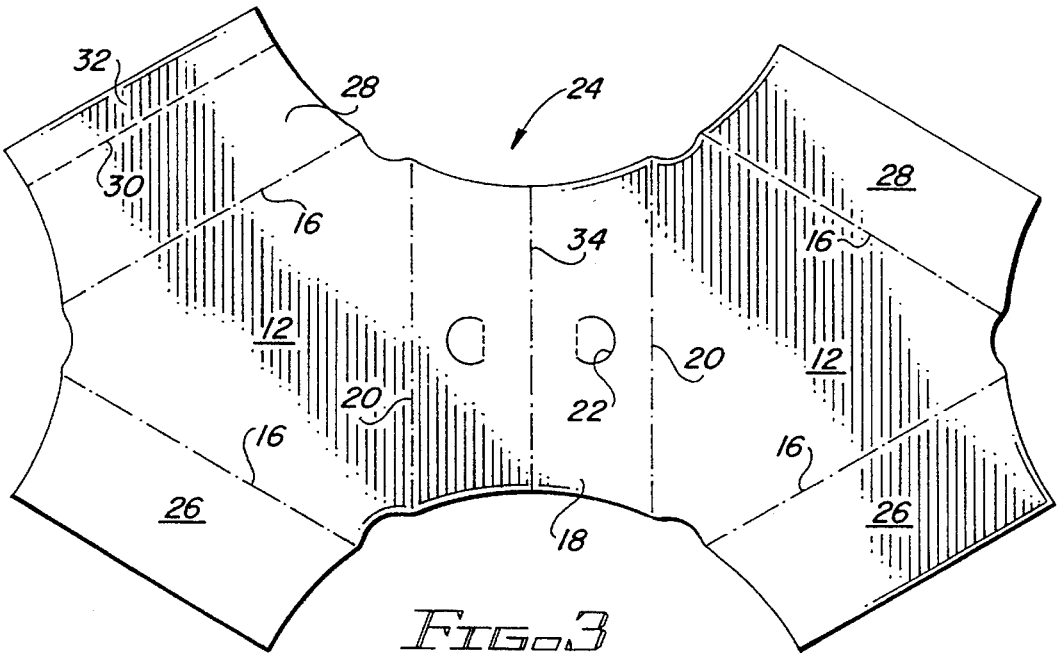
FIG. 3 is a plan view of a blank for fabricating the carrier.

Referring to FIG. 3, a blank for forming the carrier is indicated at reference numeral 24. The central portion of the blank is comprised of a generally rectangular top panel section 18, opposite sides of which are connected by fold lines 20 to similar generally triangular side panel sections 12. The end edges of each side panel section 12 are connected by fold lines 16 to end panel flaps 26 and opposite end panel flaps 28. One of the end panel flaps 28 is connected by fold line 30 to glue flap 32. The top panel section is divided in half by a central fold line 34 extending parallel to the fold lines 20. The central fold line 34 also divides the blank in half and, except for the presence of the glue flap, each half of the blank is identical.

Figure 4:
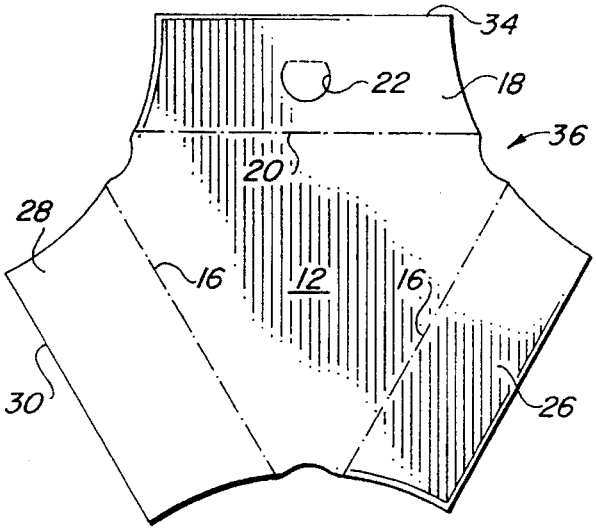
FIG. 4 is a plan view of a collapsed carrier resulting from an interim folding and gluing step.

To form a collapsed carrier from the blank, the glue flap is first folded in along the fold line 30 and glue is applied to the exposed face of the glue flap. The blank is then folded about the central fold line 34 so that opposite halves of the blank are in opposed relationship, with the glue flap 32 being adhered to the opposing end panel flap 28. This results in the collapsed carrier 36 illustrated in FIG. 4. It will be understood by those in the art that the end panels could also be formed by providing each side panel section with only one relatively large end panel flap and connecting that flap to the other side panel section. That would not be a preferred arrangement since the blank could not be as efficiently laid out in a web of stock from which the blanks are produced.

To form a finished package from the collapsed carrier 36, the end panel formed by the connected end panel flaps 28 is straightened by applying an inward force to the fold 30. This action causes the side panel sections 12 to fold inwardly about the fold lines 16 to assume the spaced parallel arrangement illustrated in FIG. 5. The opened carrier is positioned with the top panel section 18 resting on a support surface S. Since the end panel flaps 26 at this point have not yet been folded, they still extend out in the plane of the side panel sections 12. This results in the partially formed carrier having an open end opposite the end formed by the end panel flaps 28. A stack of cans C is then pushed through the open end in the direction of the arrows 38. The stack is inverted, the same as the carrier, so that the bottom row of four cans will be adjacent the top panel section 18. After the cans have been inserted the end panel flaps 26 are folded in so that they overlap, with the overlapped portions being glued together to form the other end panel, thereby completing formation of the carrier 10 of FIG. 1.

Figure 5:
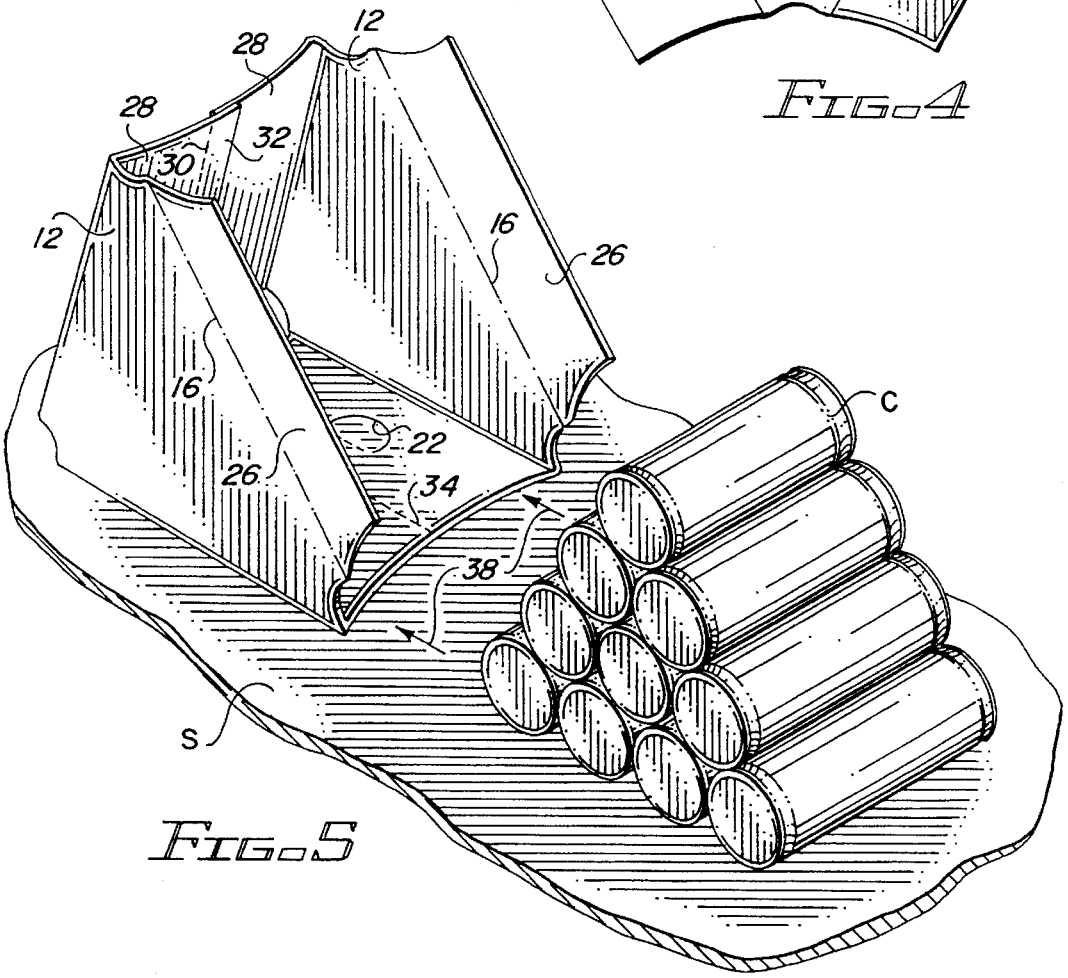
FIG. 5 is a pictorial view of a partially formed carrier just prior to insertion of beverage cans.

The cans need not be stacked as shown in FIG. 5 prior to loading the carrier. If desired, the bottom row of four cans may first be inserted, followed by the second row of three, and so on. This takes longer to complete than inserting all the cans at the same time and is not the preferred loading procedure.

The presence of the central fold line 34 in the top panel does not weaken the carrier or the top panel. The central fold line is present in order to enable the blank to be folded into collapsed carrier form for shipping and handling prior to opening the carrier for loading. Once loaded, the cans fit snugly against the side, end and top panels, acting as stiffeners. The loaded carrier is thus formed into a solid integral unit, maintained in that state by the cans, thereby preventing any tendency of the top panel to collapse back about the central fold line toward its folded condition.

Figure 6:
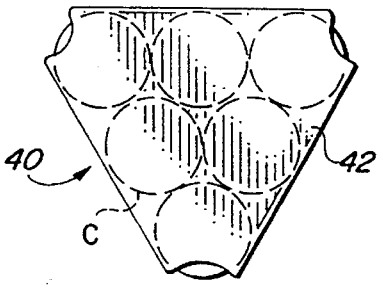
FIG. 6 is a side elevation of a modified carrier, with the location of packaged cans indicated by broken lines.

Although the carrier has been described as containing ten cans, it can be designed to hold fewer or greater numbers. The carrier 40, illustrated in FIG. 6, contains only six cans since it is made up of only three levels of cans. A carrier containing fifteen cans would be obtained by providing five layers of cans. Because of the triangular shape of the carrier, the first layer of cans will always be comprised of a single can, the next layer two, and so on. In practice, carriers containing ten or more cans would typically be utilized with relatively small cans, while packages containing six cans would typically be utilized with relatively large cans.

Figure 7:
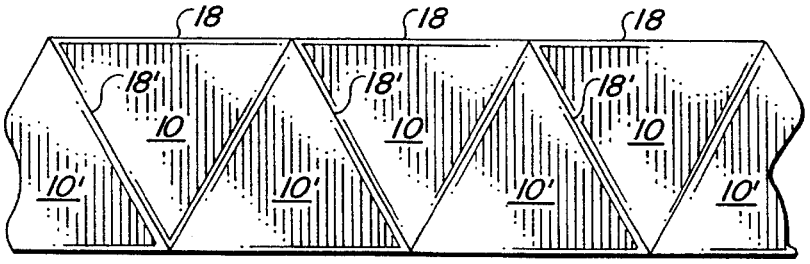
FIG. 7 is a schematic side elevation of a plurality of carriers in a stacked arrangement.

Whatever the size of the carrier, its triangular shape allows the carriers to be stacked in honeycomb fashion, one row of which is illustrated in FIG. 7. The top panels 18 of the uppermost carriers 10 are exposed so that the finger holes can be readily grasped, while the alternating carriers 10' in the row are arranged so that their top panels 18' are exposed when an adjacent carrier 10 has been removed. When the carriers are stacked in this manner for shipping or display, they are more securely held in place than are conventional rectangular carriers stacked one on top of the other.

Although the preferred design includes open areas at the upper and bottom corners, the carrier could be designed to have closed corners. This would require more material, however, and would not provide as tight a fit for the end cans in the top and bottom rows. It may, on the other hand, be satisfactory for articles which are not cylindrical in shape but are capable of being arranged in triangular fashion. Because the articles contact each other, they should not be formed of a material which is in danger of breaking should the carrier be dropped or otherwise subjected to impact forces.

The illustrated carrier has been designed to hold cylindrical cans, thus requiring that the carrier be of generally equilateral triangle shape. This is necessary because the greatest width of the cans is constant regardless of where the measurement is taken. For articles which are of varying thicknesses, such as an article which is oval or rectangular in cross section, the most efficient design may be one which is not based on an equilateral triangle but on an isosceles triangle, where the unequal leg of the triangle corresponds to the top panel of the carrier.

The various design features described contribute to the ability to rapidly and economically produce an effective, strong carrier for packaging a plurality of articles. It will be understood, however, that the invention is not limited to all the specific details described in connection with the preferred embodiment, except as they may be within the scope of the appended claims, and that changes to certain features of the preferred embodiments which do not alter the overall basic function and concept of the invention are contemplated.

What is claimed is:

1. A package comprised of an article carrier of generally triangular shape containing a plurality of articles, comprising:

opposite side panels, each side panel having opposite inwardly tapered end edges and an upper edge;

a top panel connected to the upper edges of the side panels, the top panel including handle openings;

end panels connected to associated end edges of the side panels, the end panels tapering toward, and terminating in a bottom carrier portion;

the plurality of articles extending between the side panels; and the articles being arranged in a plurality of rows, including an upper most row adjacent the top panel and a bottom row in the bottom carrier portion, each suceeding relatively higher row in the carrier containing a greater number of articles than the next lower row.

2. A package as defined in claim 1, wherein the side panels are of generally equilateral triangle shape.

3. A package comprised of an article carrier of generally triangular shape containing a plurality of articles, comprising:

opposite side panels, each side panel having opposite inwardly tapered end edges and an upper edge;

a top panel connected to the upper edges of the side panels;

end panels connected to associated end edges of the side panels, the end panels tapering toward, and terminating in, a bottom carrier portion;

the plurality of articles extending between the side panels;

the articles being arranged in a plurality of rows, including an upper most row adjacent the top panel and a bottom row in the bottom carrier portion, each relatively higher row in the carrier containing a greater number of articles than the next lower row, the bottom row of articles being comprised of a single article; and the bottom carrier portion including an opening through which a portion of the bottom article protrudes.

4. A package as defined in claim 3, wherein the articles are substantially cylindrical in shape.

5. A package as defined in claim 4, wherein the articles are comprised of beverage cans.

6. A package as defined in claim 3, wherein the top panel includes end edges which are spaced from the end panels by upper openings, portions of end articles in the upper row protruding through the upper openings.

7. A blank for forming an article carrier of generally triangular shape, comprising:

a centrally located top panel section having opposite side edges, the top panel section including handle openings;

a side panel section connected to each of the side edges of the top panel section by a fold line;

each side panel section being of generally triangular shape, each side panel section having opposite end edges converging away from the top panel section; and an end panel flap connected by fold line to at least one of the end edges of each side panel section;

a carrier formed from the blank being capable of holding a plurality of rows of articles, including an upper most row adjacent a panel of the carrier formed from the top panel section of the blank, wherein each succeding relatively higher row in the carrier formed from the blank contains a greater number of articles than the next lower row and the articles extend between the side panels of the carrier.

8. An article carrier blank as defined in claim 7, wherein the side panel sections are of generally an equilateral triangle shape.

9. A blank for forming an article carrier of generally triangular shape, comprising:

a centrally located top panel section having opposite side edges;

a side panel section connected to each of the side edges of the top panel section by a fold line;

each side panel section being of generally triangular shape, each side panel section having opposite end edges converging away from the top panel section; and an end panel flap connected by fold line to at least one of the end edges of each side panel section;

a carrier formed from the blank being capable of holding a plurality of rows of articles, including an upper most row adjacent a panel of the carrier formed from the top panel section of the blank, wherein each succeding relatively higher row in the carrier formed from the blank contains a greater number of articles than the next lower row and the articles extend between the side panels of the carrier;

the converging end edges of the side panel sections terminating short of intersecting so that a carrier formed from the blank includes an open bottom portion through which a portion of a lowermost article in the carrier would protrude.

10. A blank for forming an article carrier of generally triangular shape, comprising:

a centrally located top panel section having opposite side edges;

a side panel section connected to each of the side edges of the top panel section by a fold line;

each side panel section being of generally triangular shape, each side section having opposite end edges converging away from the top panel section; and an end panel flap connected by fold to at least one of the end edges of each side panel section;

a carrier formed from the blank being capable of holding a plurality of rows of articles, including an upper most row adjacent a panel of the carrier formed from the top panel section of the blank, wherein each succeding relatively higher row in the carrier formed from the blank contains a greater number of articles than the next lower row and the articles extend between the side panels of the carrier;

the top panel section, the side panel sections and the end panel flaps being shaped such that a carrier formed from the blank includes open areas at the ends of the top panel of the carrier through which portions of adjacent articles can protrude.

* * * * *